US012703526B2

(12) United States Patent
Chung et al.

(10) Patent No.: US 12,703,526 B2
(45) Date of Patent: Aug. 11, 2026

(54) AUTOMATIC PACKAGING BAG CLOSING DEVICE

(71) Applicant: LG Energy Solution, Ltd., Seoul (KR)

(72) Inventors: Sung Hee Chung, Daejeon (KR); Byeong Oh Jeong, Daejeon (KR); Seung Jae Won, Daejeon (KR)

(73) Assignee: LG Energy Solution, Ltd., Seoul (KR)

( * ) Notice: Subject to any disclaimer, the term of this patent is extended or adjusted under 35 U.S.C. 154(b) by 0 days.

(21) Appl. No.: 18/880,625

(22) PCT Filed: Feb. 23, 2024

(86) PCT No.: PCT/KR2024/002363
§ 371 (c)(1),
(2) Date: Jan. 2, 2025

(87) PCT Pub. No.: WO2024/191075
PCT Pub. Date: Sep. 19, 2024

(65) Prior Publication Data

US 2026/0001668 A1 Jan. 1, 2026

(30) Foreign Application Priority Data

Mar. 13, 2023 (KR) ..... 10-2023-0032347

(51) Int. Cl.

| | |
|---|---|
| ***B65B 1/06*** | (2006.01) |
| ***B65B 43/46*** | (2006.01) |
| ***B65B 43/54*** | (2006.01) |
| ***B65B 57/06*** | (2006.01) |

(52) U.S. Cl.
CPC ..... *B65B 1/06* (2013.01); *B65B 43/465* (2013.01); *B65B 43/54* (2013.01); *B65B 57/06* (2013.01)

(58) Field of Classification Search
CPC ..... B65B 1/06; B65B 43/465; B65B 43/54; B65B 57/06; B65B 69/0083; B65B 43/30; B65B 1/02; B65B 31/045; B65B 39/08
See application file for complete search history.

(56) References Cited

U.S. PATENT DOCUMENTS

| | | | | |
|---|---|---|---|---|
| 5,417,039 | A | 5/1995 | Hansson et al. | |
| 6,035,606 | A * | 3/2000 | Bussey, III | B65B 51/04 53/385.1 |
| 2003/0155452 | A1 | 8/2003 | Herget | |
| 2015/0151045 | A1 | 6/2015 | Anderson et al. | |

(Continued)

FOREIGN PATENT DOCUMENTS

| | | | |
|---|---|---|---|
| CN | 112224533 | A | 1/2021 |
| CN | 215476074 | U | 1/2022 |
| CN | 215664363 | U * | 1/2022 |

(Continued)

OTHER PUBLICATIONS

Machine Translation of JP-2000296818-A (Year: 2025).*

(Continued)

*Primary Examiner* — Veronica Martin
(74) *Attorney, Agent, or Firm* — Lerner David LLP

(57) ABSTRACT

An automatic packaging bag closing device having a pair of clamping units installed in a horizontal direction on both sides near an inlet of a hopper and configured to pressurize and close a lower part of an empty packaging bag when raw material input into the hopper is completed is provided.

10 Claims, 2 Drawing Sheets

(56) References Cited

U.S. PATENT DOCUMENTS

2019/0233154 A1 8/2019 Mayrpeter et al.

FOREIGN PATENT DOCUMENTS

| | | | | | |
|---|---|---|---|---|---|
| EP | 2128052 | A2 | * | 12/2009 | ..... B66C 13/06 |
| EP | 2128052 | B1 | | 10/2012 | |
| JP | H07025478 | A | | 1/1995 | |
| JP | 2000006932 | A | | 1/2000 | |
| JP | 2000296818 | A | * | 10/2000 | |
| JP | 2003246462 | A | | 9/2003 | |
| JP | 2004174339 | A | | 6/2004 | |
| JP | 2018122925 | A | | 8/2018 | |
| KR | 101094527 | B1 | | 12/2011 | |
| KR | 200475623 | Y1 | | 12/2014 | |
| KR | 101484924 | B1 | | 1/2015 | |
| KR | 101586583 | B1 | | 1/2016 | |
| KR | 101731582 | B1 | | 4/2017 | |
| KR | 102244046 | B1 | | 4/2021 | |
| KR | 20220130509 | A | | 9/2022 | |
| WO | WO-2024178398 | A1 | * | 8/2024 | ..... B65B 1/08 |

OTHER PUBLICATIONS

Machine Translation of CN-215664363-U (Year: 2025).*
Machine Translation of EP-2128052-A2 (Year: 2025).*
International Search Report for Application No. PCT/KR2024/002363 mailed Jun. 12, 2024. 4 pages.

* cited by examiner

AUTOMATIC PACKAGING BAG CLOSING DEVICE

CROSS-REFERENCE TO RELATED APPLICATIONS

This application is a 371 National Stage entry of PCT/KR2024/002363, filed Feb. 23, 2024, which claims the benefit of foreign priority to Korean Patent Application No. 10-2023-0032347 filed Mar. 13, 2023, the disclosures of which are incorporated by reference herein in their entirety.

TECHNICAL FIELD

The present disclosure relates to an automatic packaging bag closing device and an automation device for packaging bag transport and input comprising the same.

BACKGROUND

A packaging bag (container bag) is a type of packaging container accommodating raw materials such as battery electrode active materials (active substances). Such a packaging bag may be a flexible container bag that is flexible and deformable, and the flexible container bag is also abbreviated as a flecon bag.

Conventionally, when the active material was completely input into a hopper, and then the empty packaging bag was recovered, there was a possibility that a small amount of active material powder would scatter through a discharge part.

Also, conventionally, a worker manually introduced active materials to all parts using a manual hoist. Specifically, conventionally, the worker transported packaging bags using a manual hoist, and adjusted the amount of input while visually observing the discharge of the active material, and when the discharge was not smooth due to agglomeration of the active material, the worker continued to perform the discharge while hitting it with a hammer to remove the agglomeration, and when the discharge was completed, the worker tied the end of the discharge part with a string to prevent the remaining amount from falling out.

Therefore, a packaging bag control technology is needed to inject the active material into a hopper, as follows.

1) Packaging bag transport
2) Tilting during packaging bag transport
3) Automatic sensing packaging bag weight and packaging bag height correction according to discharge of active material into hopper (as the active material is discharged from the packaging bag, the length of the packaging bag increases, the height must be raised by the increased length)
4) Upon discharge stop due to agglomeration of the active material in the packaging bag, agglomeration needs to be resolved
5) After completion of packaging bag active material discharge, blocking discharge of insignificant active materials remaining in the outlet (blocks so that the remaining amount does not fall to the floor)

SUMMARY

Technical Problem

Therefore, it is an object of the present disclosure to provide a device automatically closing a packaging bag after inputting an active material.

It is another object of the present disclosure to provide an automation device for packaging bag transport and active material input automatically performing the packaging bag transport and the active material input.

Technical Solution

To achieve the above-described objects, the present disclosure provides an automatic packaging bag closing device comprising: a pair of clamping units installed in a horizontal direction on both sides near an inlet of a hopper and configured to pressurize and close a lower part of an empty packaging bag in which raw material input into the hopper is completed.

In the present disclosure, the pair of clamping units may be symmetrically disposed around the inlet of the hopper on the same height.

In the present disclosure, each clamping unit may comprise a cylinder, a rod installed to be movable forward and backward on the cylinder, and a pusher connected to the rod and configured to pressurize the packaging bag.

In the present disclosure, a pair of pushers may be disposed to face each other, and the respective pushers may move forward on the inside and pressurize both sides of the lower part of the packaging bag to be plastically deformed, thereby being closed.

In addition, the present disclosure provides an automation device for packaging bag transport and input comprising: a rail disposed at a height in a horizontal direction: a hanger mounted on the rail and configured to reciprocate in the horizontal direction, the hanger configured to reciprocate the packaging bag mounted at a lower end of the hanger in a vertical direction: a hopper disposed below the rail and configured to receive raw materials inside the packaging bag moved by the hanger: and a pair of clamping units installed in the horizontal direction on both sides near an inlet of the hopper and configured to pressurize and close a lower part of an empty packaging bag in which raw material input into the hopper is completed.

The automation device for packaging bag transport and input according to the present disclosure may further comprise a hit post disposed near the inlet of the hopper and configured to resolve an agglomeration phenomenon of the raw materials as the packaging bag is hit by the vertical direction reciprocation of the hanger.

In the present disclosure, the hanger may comprise an upper hanger mounted on the rail, a lower hanger disposed below the upper hanger, a wire installed between the upper hanger and the lower hanger, and at least one hook mounted on the lower hanger to hang the packaging bag.

In the present disclosure, a location hole may be positioned on any one of the upper hanger and the lower hanger, and a location pin inserted into the location hole, may be positioned on the other one of the upper hanger and the lower hanger that does not include the location hole.

In the present disclosure, the at least one hook may include a pair of hooks, wherein the pair of hooks may be configured to grip a string-shaped sling bar of the packaging bag at two points, and wherein the pair of hooks may have a gap so as to minimize a height of the packaging bag.

In the present disclosure, the hanger may further comprise load cells installed on both left and right sides of the lower hanger.

In the present disclosure, the hanger may be configured to correct a tilt of the packaging bag by sensing a weight deviation on the load cells on both left and right sides of the lower hanger, and the hanger may be configured to adjust a height of the packaging bag based on a weight change sensed by the load cells on both left and right sides of the lower hanger.

In the present disclosure, the hopper may comprise upper and lower photo-electric sensors installed near the inlet in the vertical direction and configured to sense the position of the discharge part end of the packaging bag.

In the present disclosure, the hit post may comprise a support installed on both sides of the hopper, and a hitting plate extending inwardly from the upper end of the support.

Advantageous Effects

The automatic packaging bag closing device according to the present disclosure can automate finishing operations of empty packaging bags after inputting raw materials, thereby reducing worker man-hours compared to the conventional art.

Also, the automation device for packaging bag transport and input according to the present disclosure can provide a packaging bag automation control (OHT) and control (clamping unit, hit post) technology for introducing active materials into a hopper. In addition, as the active materials are automatically introduced into the hopper, it is possible to reduce the number of workers, and it is possible to reduce the risk of safety accidents caused by handling high load (1 ton) active materials.

DETAILED DESCRIPTION

Figure 1:
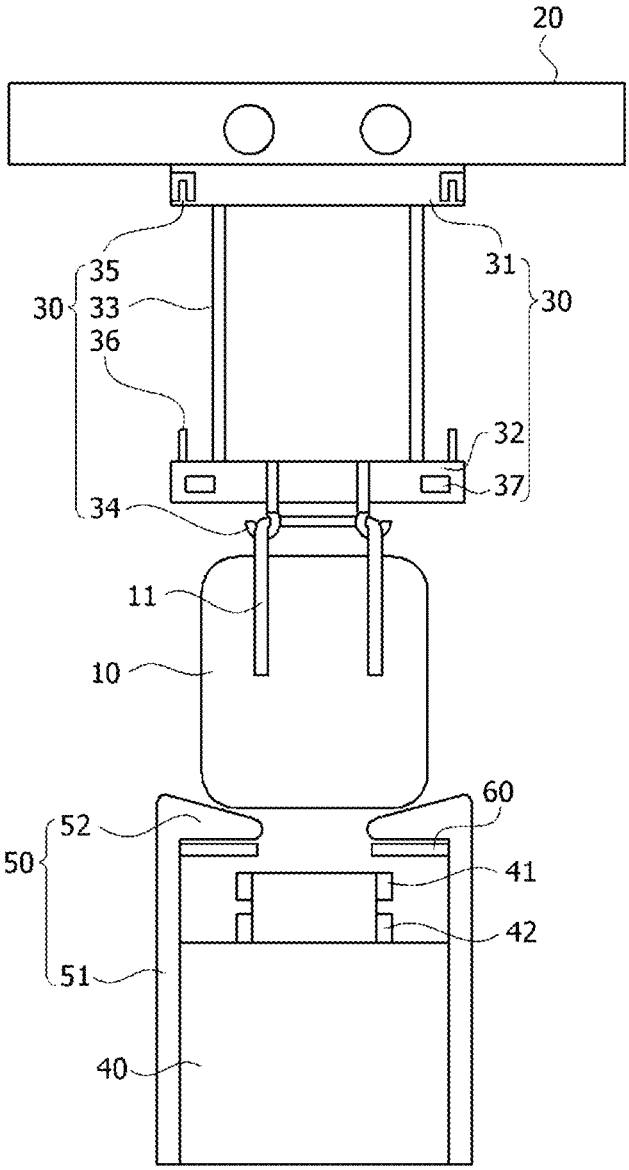
FIG. 1 is a front view showing an automation device for packaging bag transport and input according to the present disclosure.

Hereinafter, the present disclosure will be described in detail with reference to the accompanying drawings.

Reference characters used in the present disclosure are as follows:

10: packaging bag
11: sling bar
20: rail
30: hanger
31: upper hanger
32: lower hanger
33: wire
34: hook
35: location hole
36: location pin
37: load cell
40: hopper
41: upper photo-electric sensor
42: lower photo-electric sensor
43: inlet
50: hit post
51: support
52: hitting plate
60: clamping unit
61: cylinder
62: rod
63: pusher The present disclosure relates to an automatic packaging bag closing device and an automation device for packaging bag transport and input comprising the same, wherein the packaging bag (10) is a big bag accommodating raw materials, which may be, for example, a flexible container bag (flecon bag) that is flexible and deformable. At least one sling bar (11) in the form of a bag strap may be provided at the top of the packaging bag (10) to hang it on a hook (34) of a hanger (30), and an openable and closable raw material discharge part may be provided at the bottom of the packaging bag (10). The packaging bag (10) may be composed of an outer packaging material and an inner packaging material. The raw materials are not particularly limited, which may be, for example, mixer process active materials, and the like, and specifically, active materials (active substances) of battery electrodes (negative electrode, and positive electrode), and the like. The raw materials may be accommodated in the packaging bag (10) in the form of powder (pulverulent body) or particles.

Referring to FIG. 1 or the like, the automation device for packaging bag transport and input according to the present disclosure may be composed of a rail (20), a hanger (30), a hopper (40), a hit post (50), a clamping unit (60), and the like.

The rail (20) is for moving the hanger (30), which may be disposed above a certain height (for example, 3 to 10 m) in a horizontal direction to implement OHT (overhead hoist transfer). The rail (20) may be fixed or supported through an appropriate fixing or supporting means on the ceiling or floor, and the like. The shape and size of the rail (20), and the like are not particularly limited, which may be set appropriately.

The hanger (30) (also called carrier) is for moving the packaging bag (10), which may enable to be mounted on the rail (20), thereby reciprocating in the horizontal direction along the rail (20), and may also enable to reciprocate the packaging bag (10) mounted at the lower end in the vertical direction.

The horizontal reciprocation and vertical reciprocation of the hanger (30) are possible by conventional mechanisms (pulleys and belts, gears and chains, cylinders and pistons, racks and pinions, reels, and wires, etc.) which convert rotary motion of a motor into linear motion, and which may be appropriately selected among the foregoing, as needed.

The hanger (30) may be composed of an upper hanger (31), a lower hanger (32), a wire (33), a hook (34), a location hole (35), a location pin (36), a load cell (37), and the like.

The upper hanger (31) may be mounted below the rail (20), and may be configured in a plate shape (a polygonal plate such as a rectangular plate, a circular plate, an oval plate, etc.). The lower hanger (32) may be disposed below the upper hanger (31), and may be configured in the same plate shape as the upper hanger (31).

The wire (33) may be installed between the upper hanger (31) and the lower hanger (32) to connect them. The upper end of the wire (33) may be fixed to a roller or reel, and the like installed on the upper hanger (31) or the rail (20), and the like, and the lower end of the wire (33) may be fixed to the lower hanger (32). The wire (33) may be wound and unwound through the roller or reel, and the like, whereby it is possible to reciprocate the lower hanger (32) in the vertical direction.

The hook (34) may be mounted on the lower hanger (32) and configured in a ring shape, thereby hanging the packaging bag (10). The hook (34) may consist of at least one pair (preferably, two pairs or more), where the one pair of hooks (34) may grip the strap-shaped sling bar (11) of the packaging bag (10) at two points, but may have a gap to minimize the heights of the packaging bag (10) and sling bar (11) (wide double hooks are applied).

When the hook (34) is at the highest height, that is, when the lower hanger (32) rises to come into close contact with the upper hanger (31), the height between the upper end of the rail (20) and the lower end of the hook (34) may be, for example, up to 1.2 m. The height of the packaging bag (10) including the sling bar (11) hung on the hook (34) may be, for example, 1.8 m. The height of the manual work space between the lower end of the packaging bag (10) and the upper end of the hopper (40) may be, for example, 0.5 m. The height between the lower end of the hook (34) located at the highest height and the upper end of the hopper (40) may be, for example, up to 2.3 m. In this way, the floor height may be insufficient, so that a solution to the floor height lack is needed.

To solve the problem of floor height lack, it is possible to minimize the height of the packaging bag (10) by maximizing the two-point gripping distance for each sling bar. Upon the one-point grip of the sling bar (11), the sling bar (11) hangs loosely on the hook (34) to be added thereto up to the height of the sling bar (11), thereby increasing the height of the packaging bag (10). That is, upon the two-point grip of the sling bar (11), the height of the sling bar (11) decreases and simultaneously the height of the packaging bag (10) decreases. Particularly, by maximizing the distance (interval) between the pair of hooks (34) corresponding to the gripping distance upon the two-point grip, it is possible to minimize the height of the packaging bag (10), and in this case, the upper end of the packaging bag (10) may be made in close contact with or almost in close contact with the hook (34).

In addition, it is possible to solve the floor height lack by compacting the running rail (20) and the hanger (30). Specifically, upon docking of the upper hanger (31) and the lower hanger (32), the hook (34) is positioned at the highest height, where it is preferable that the height between the upper end of the rail (20) and the lower end of the hook (34) is designed to be up to 1.2 m.

A location hole (35) may be formed on any one side of the upper hanger (31) and the lower hanger (32), and a location pin (36) inserted into the location hole (35) may be formed on the other side. In FIG. 1, the location hole (35) is formed in the upper hanger (31), and the location pin (36) is formed in the lower hanger (32), but the location of the location hole (35) and the location pin (36) may be reversed on the upper hanger (31) and lower hanger (32). The location hole (35) may be formed in the form of a groove or hole on the lower surface of the upper hanger (31), and the location pin (36) may be formed in the form of a protrusion on the upper surface of the lower hanger (32).

At least one pair of location holes (35) may be formed on both sides of the upper hanger (31), and similarly, at least one pair of location pins (36) may be formed on both sides of the lower hanger (32). The location hole (35) and the location pin (36) may have shapes and sizes that correspond to each other. While the packaging bag (10) moves upward along the lower hanger (32) and the hook (34), and the upper hanger (31) and lower hanger (32) come into close contact with each other, the location hole (35) and the location pin (36) may be docked.

Upon left and right movement of the packaging bag (10), there may be a problem that the packaging bag (10) shakes in left and right directions, but through the docking of the location hole (35) and the location pin (36), and the two-point grip of the sling bar (11), it is possible to solve or minimize the problem of left and right shaking of the packaging bag (10) when the packaging bag (10) is moved left and right.

The hanger (30) may further comprise a scissor frame (not shown). The scissor frame is installed between the upper hanger (31) and the lower hanger (32), and is capable of expansion and contraction (deformation) in the vertical (height) direction. The upper end of the scissor frame may be fixed to the upper hanger (31), and the lower end of the scissor frame may be fixed to the lower hanger (32). When the packaging bag (10) is lowered, the height of the scissor frame may increase, and when the packaging bag (10) is raised, the height of the scissor frame may decrease. The scissor frame may simply be passively elongated and contracted by active movement of the wire (33).

Even upon up and down movement of the packaging bag (10), there may be a problem that the packaging bag (10) shakes in the left and right directions, but by applying the scissor frame between the upper hanger (31) and the lower hanger (32), it is possible to solve or minimize the problem of left and right shaking of the packaging bag (10) when the bag (10) is moved up and down.

The packaging bag (10) may be tilted to one side when the active material is introduced. In addition, the length of the packaging bag (10) may increase when the active material is introduced. To solve the problems of tilt and length increase of the packaging bag (10), load cells (37) may be installed on both left and right sides of the lower hanger (32). At least one pair of load cells (37) may be installed on both sides of the lower hanger (32), and may measure weights in real time. By sensing the weight deviation using the load cells (37) on both left and right sides, it is possible to correct the tilt of the packaging bag (10), and it is possible to adjust the height of the packaging bag (10) according to the weight change sensed by the load cells (37) on both left and right sides.

For example, when the packaging bag (10) is tilted downward to the right, the load cells (37) sense the weight deviation to adjust the displacement of the right wire (33), whereby it is possible to align it by correcting the tilt of the packaging bag (10). In addition, when the length of the packaging bag (10) increases, the load cells (37) sense the weight change, and the wire (33) rises, whereby it can be corrected by offsetting the length increase of the packaging bag (10).

The hopper (40) is disposed below the rail (20), and is a place where raw materials inside the packaging bag (10) moved to the hanger (30) are input, and when the height of the packaging bag (10) is adjusted, the discharge part of the packaging bag (10) may be separated from the hopper (40), and accordingly, there may be a problem that the active material scatters. Therefore, when the height of the packaging bag (10) is adjusted, it is necessary to maintain the entry depth of the discharge part of the packaging bag (10) into the hopper (40).

To solve the active material scattering problem, an upper photo-electric sensor (41) and a lower photo-electric sensor (42) may be installed vertically near the inlet (43) of the hopper (40) to sense the position of the end of the discharge part (12) of the packaging bag (10). At least one pair of the upper photo-electric sensors (41) may be mounted on both sides of the upper part of the hopper (40), and sense the minimum (Min.) position of the end of the discharge part of the packaging bag (10). At least one pair of the lower photo-electric sensors (42) may be mounted on both sides of the bottom of the inlet (43) of the hopper (40), and sense the maximum (Max.) position of the end of the discharge part of the packaging bag (10). By reflecting the sensing results of both photo-electric sensors (41, 42), it is possible to lower the packaging bag (10) when the minimum (Min.) position is sensed, and it is possible to raise the packaging bag (10) when the maximum (Max.) position is sensed.

The active material agglomeration may occur near the discharge part of the packaging bag (10) to stop the discharge. To solve the active material agglomeration problem, the hit post (50) may be disposed near the inlet (43) of the hopper (40). The hit post (50) may be in a fixed type, and may be composed of a support (51) installed on both sides of the hopper (40), and a hitting plate (52) extending inwardly from the upper end of the support (51). The packaging bag (10) may be hit to the hitting plate (52) of the hit post (50) by the vertical direction reciprocation of the hanger (30) to resolve the agglomeration phenomenon of the active material.

Specifically, if there is no weight change sensed by the load cell (37), it is regarded that the agglomeration phenomenon of the active material has occurred, and as the packaging bag (10) is repeatedly lowered and raised to collide the packaging bag (10) with the hitting plate (52) of the fixed hit post (50), it is possible to resolve the active material agglomeration. The load cell (37) may sense the moment when the packaging bag (10) is hit (collided) to the hit post (50).

Conventionally, the hopper fitting input and finishing work was performed manually. Specifically, after confirming the input weight, a worker finished by grabbing the discharge part of the packaging bag (10). That is, conventionally, after completing the raw material input, the input of a worker was required for a packaging material finishing work inside the packaging bag (10). To solve this existing manual work problem, a forward/backward stroke type clamping unit (60) for finishing the inner packaging material is added, whereby the discharge of raw materials can be blocked by finishing the lower part of the empty packaging bag (10) in which the raw material input into the hopper (40) is completed.

Figure 2:
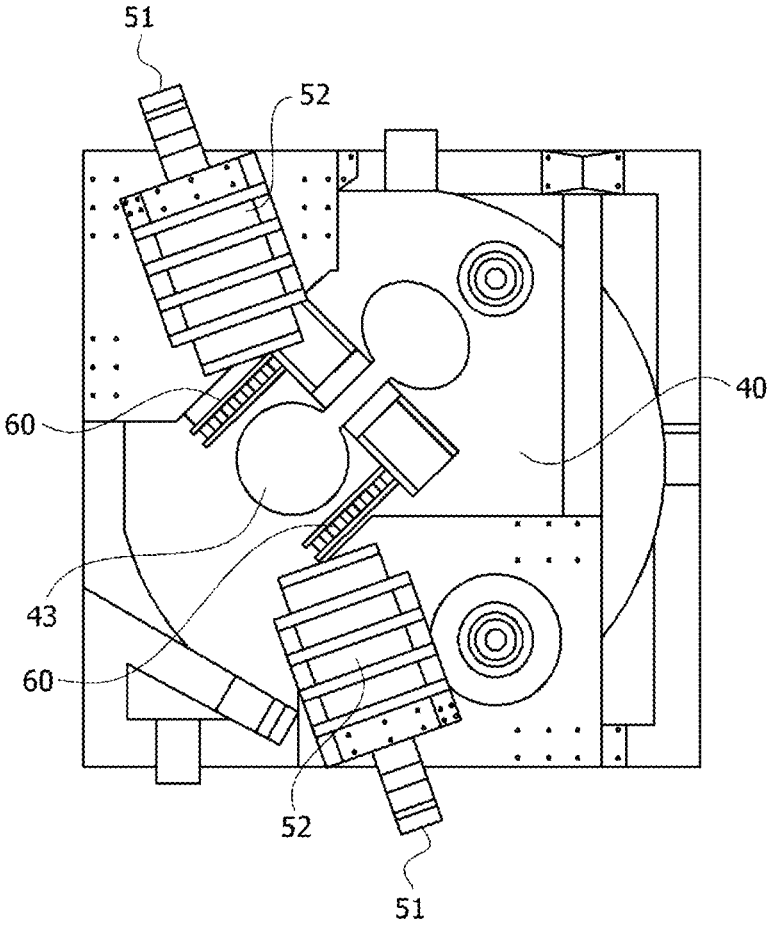
FIG. 2 is a plan view showing a hopper equipped with an automatic packaging bag closing device according to the present disclosure.
Figure 3:
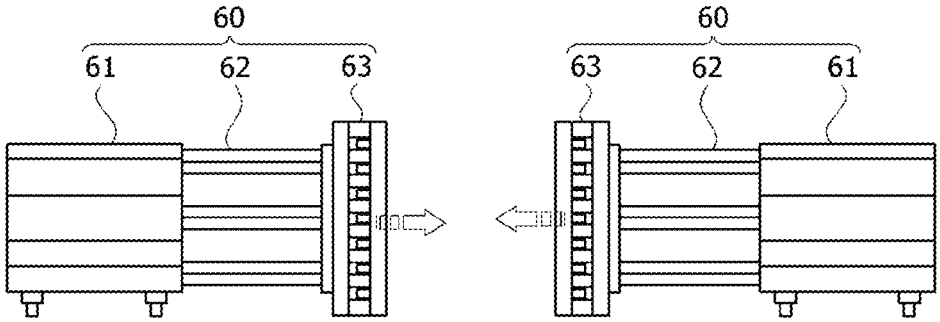
FIG. 3 is a plan view specifically showing an automatic packaging bag closing device according to the present disclosure.

Referring to FIG. 1, FIG. 2, and FIG. 3, the clamping unit (60) may be installed in a horizontal direction on both sides near the inlet (43) of the hopper (40). The clamping unit (60) may be disposed below the hitting plate (52) of the hit post (50), and may be fixed to the support (51) or the like. A pair of clamping units (60) may be symmetrically disposed around the inlet (43) of the hopper (40) on the same height. A pair of clamping units (60) may be disposed to face each other on opposite sides, for example, at an interval of 180 degrees.

Referring to FIG. 3, each clamping unit (60) may comprise a cylinder (61), a rod (62) installed to be movable forward and backward on the cylinder (61), and a pusher (63) connected to the rod (62) and pressurizing the packaging bag (10). The cylinder (61) may be, for example, an air cylinder. The rod (62) may be composed of one or a plurality of rods. The pusher (63) may be, for example, a rectangular flat plate. A pair of pushers (63) may be disposed to face each other, and the respective pushers may move forward on the inside toward the center to pressurize both sides of the lower part of the inner packaging material of the packaging bag (10), thereby plastically deforming and finishing the packaging bag (10). When the packaging bag (10) reaches a certain weight, the discharge of the active material can be blocked and finished using the clamping unit (60).

As such, in the present disclosure, it is possible to prevent the residual quantity of raw materials from falling by plastically deforming the inner packaging material with the finishing clamp of the dumping hopper post unit. Compared to the existing manual process that the worker moves to the hopper input workstation and finishes the inner packaging material after the input of raw materials (active materials) is completed, the present disclosure automates packaging bag finishing and empty bag recovery processes, so that the man-hours can be reduced.

Hereinafter, the transport of the packaging bag, the hopper input of raw materials, and the finishing process of the packaging bag will be sequentially described. Only one rail (20) may be installed, and a plurality of hangers (30), hoppers (40), hit posts (50), clamping units (60), and the like may be installed. The packaging bag (10) may be mounted on a stand.

First, the hanger (30) is lowered, the worker fixes the packaging bag (10) to the hanger (30), and presses a work completion button after fixing (manual process).

Next, the hanger (30) is raised by the OHT, the packaging bag (10) is transported to the designated hopper (40) position along the rail (20), and then the hanger (30) is lowered (automatic process).

Next, the worker dismantles the bottom of the packaging bag (10), connects it to the inside of the hopper (40), and then presses the work completion button (manual process).

Next, the internal material of the packaging bag (10) is introduced into the hopper (40) by the OHT and simultaneously the weight is measured in real time with the load cell (37), and when the internal material of the packaging bag (10) agglomerates without any weight change, the packaging bag (10) is moved up/down and simultaneously collides with the hit post (50) to resolve the agglomeration (automatic process).

Next, the weight of the packaging bag (10) is measured in real time on the hanger (30) by the OHT using the load cell (37), and as the length of the packaging bag (10) is increased according to the discharge of the internal material of the packaging bag (10), the entire height of the packaging bag (10) is corrected, and simultaneously the internal material is introduced into the hopper (40) (automatic process). Upon adjusting the entire height of the packaging bag (10), the position of the end of the discharge part is sensed using photo-electric sensors (41, 42) so that the end of the discharge part does not fall out of the hopper (40).

Next, when the material input is completed by the OHT and the weight sensed by the load cell (37) becomes 0, the inner packaging material of the packaging bag (10) is plastically deformed and finished with the clamping unit (60), so that the residual quantity of the finely remaining raw material does not come out of the discharge part (automatic process).

Next, the hanger (30) is raised by the OHT, and the input-completed empty packaging bag (10) is transported to the recovery position along the rail (20), and then the hanger (30) is lowered (automatic process).

Next, the worker detaches and discards the empty packaging bag (10) transported to the recovery location (manual process).

In short, the work sequence is as follows. Hanger (carrier) (30) lowering→packaging bag (10) transfer and hanger (30) raising→packaging bag (10) transport to hopper (40) (horizontal movement along rail (20))→load cell (37) weight deviation sensing and packaging bag (10) alignment (correction for tilt, etc.)→packaging bag (10) lowering and active material input to hopper (40)→agglomeration resolution by hitting bottom of packaging bag (10) to hit post (50)→set weight input and then discharge blocking with clamping unit (60) (fitting input)→empty packaging bag (10) raising and recovery position movement.

As described above, in the present disclosure, the packaging bag (10) can be automatically controlled and the active material can be introduced by applying the OHT. Specifically, in the present disclosure, the rail (20) can automatically transport the packaging bag (10) mounted on the hanger (30) by applying the OHT disposed above a certain height; when the change of the discharged weight due to agglomeration of the active material is insignificant by measuring the transport weight in real time with the load cell (37) applied to the hanger (30), the agglomeration can be resolved by moving the packaging bag (10) up and down to collide with the hit post (50); and if the discharge into the hopper (40) is completed, the remaining amount can be kept from falling to the floor by deforming the inner packaging material using the clamping units (60) so that the slight remaining amount does not fall to the floor.

The invention claimed is:

1. An automation device for packaging bag transport and input comprising:

a rail disposed at a height in a horizontal direction;

a hanger mounted on the rail and configured to reciprocate in the horizontal direction, the hanger configured to reciprocate a packaging bag mounted at a lower end of the hanger in a vertical direction;

a hopper disposed below the rail and configured to receive raw materials from inside the packaging bag moved by the hanger; and a pair of clamping units installed in the horizontal direction on both sides near an inlet of the hopper and configured to pressurize and close a lower part of the packaging bag after raw material input into the hopper is completed, wherein the hanger comprises an upper hanger mounted on the rail, a lower hanger disposed below the upper hanger, a wire installed between the upper hanger and the lower hanger, and at least one hook mounted on the lower hanger configured to hang the packaging bag, and wherein a location hole is positioned on one hanger of the upper hanger and the lower hanger, and a location pin, configured to be inserted into the location hole, is positioned on an other hanger of the upper hanger and the lower hanger.

2. The automation device for packaging bag transport and input according to claim 1, further comprising:

a hit post disposed near the inlet of the hopper and configured to hit the packaging bag by a reciprocation of the hanger in the vertical direction, thereby resolving an agglomeration of the raw material.

3. The automation device for packaging bag transport and input according to claim 1, wherein the at least one hook includes a pair of hooks, wherein the pair of hooks is configured to grip a string-shaped sling bar of the packaging bag at two points, and wherein the pair of hooks has a gap so as to minimize a height of the packaging bag.

4. The automation device for packaging bag transport and input according to claim 1, wherein the hanger further comprises load cells installed on two sides of the lower hanger.

5. The automation device for packaging bag transport and input according to claim 4, wherein the hanger is configured to correct a tilt of the packaging bag by sensing a weight deviation on the load cells, the hanger being configured to adjust a height of the packaging bag based on a weight change sensed by the load cells.

6. The automation device for packaging bag transport and input according to claim 1, wherein the hopper comprises upper and lower photo-electric sensors installed near the inlet in the vertical direction and configured to sense a position of a discharge part end of the packaging bag.

7. The automation device for packaging bag transport and input according to claim 2, wherein the hit post comprises a support installed on both sides of the hopper, and a hitting plate extending inwardly from an upper end of the support.

8. The automation device for packaging bag transport and input according to claim 1, wherein the pair of clamping units is symmetrically disposed around the inlet of the hopper and a height of a first clamping unit of the pair of clamping units equals a height of a second clamping unit of the pair of clamping units.

9. The automation device for packaging bag transport and input according to claim 1, wherein each clamping unit of the pair of clamping units includes:

a cylinder, a rod installed to be movable forward and backward on the cylinder, and a pusher connected to the rod and configured to pressurize the packaging bag.

10. The automation device for packaging bag transport and input according to claim 9, wherein the pusher of each clamping unit of the pair of clamping units together form a pair of pushers disposed to face each other, and when the pair of clamping units pressurize, the pair of pushers are configured to move inward and pressurize both sides of the lower part of the packaging bag to plastically deform and thereby close.

* * * * *